US012287171B2

(12) United States Patent
Potter et al.

(10) Patent No.: US 12,287,171 B2
(45) Date of Patent: Apr. 29, 2025

(54) ARCHERY BOW SLING AND RELATED METHOD OF USE

(71) Applicant: Bohning Company, Ltd., Lake City, MI (US)

(72) Inventors: Robert L. Potter, McBain, MI (US); Kevin D. Mist, Cadillac, MI (US); Scott M. Billsby, Cadillac, MI (US)

(73) Assignee: Bohning Company, Ltd., Lake City, MI (US)

( * ) Notice: Subject to any disclaimer, the term of this patent is extended or adjusted under 35 U.S.C. 154(b) by 327 days.

(21) Appl. No.: 18/100,346

(22) Filed: Jan. 23, 2023

(65) Prior Publication Data

US 2024/0247907 A1 Jul. 25, 2024

(51) Int. Cl.
*F41B 5/14* (2006.01)

(52) U.S. Cl.
CPC ..... *F41B 5/1457* (2013.01); *F41B 5/1446* (2013.01)

(58) Field of Classification Search
CPC . A45F 3/02; A63C 11/02; A63C 17/00; F41B 5/063; F41B 5/066; F41B 5/10; F41B 5/105; F41B 5/14; F41B 5/1446; F41B 5/1449; F41B 5/1457; F41B 5/1461; Y10S 224/913; Y10S 224/916
USPC ..... 224/607
See application file for complete search history.

(56) References Cited

U.S. PATENT DOCUMENTS 3,058,505 A * 10/1962 Emmett ..... F41B 5/06 224/916
4,073,328 A * 2/1978 Franklin ..... F41B 5/063 124/25.7
5,465,887 A 11/1995 Hudson
7,770,768 B1 * 8/2010 Primos ..... A45F 3/02 224/609
2021/0310763 A1 10/2021 Jones

OTHER PUBLICATIONS

Sitka Bow Sling, downloaded Sep. 16, 2022.

* cited by examiner

*Primary Examiner* — Nathan J Newhouse
*Assistant Examiner* — Matthew T. Theis
(74) *Attorney, Agent, or Firm* — Warner Norcross + Judd LLP

(57) ABSTRACT

An archery bow sling can include one or more cam covers that can cover respective cams of an archery bow, a base panel, an arrowhead hood extending away from a cam cover adjacent the base panel, an arrow retainer between the hood and another cam cover, the arrow retainer defining slots configured to receive one or more arrows; and a sling strap joined with the cam covers on opposing ends of the sling. The sling can be selectively removable from the archery bow with the arrows being carried by the sling and separate from the archery bow, which can itself be quiver-less. The sling can include a fletching guard distal from the hood and configured to extend over fletchings on the arrows, and a string cover panel that provides a string compartment configured to receive and/or protect a bowstring of the bow. A related method of use is provided.

19 Claims, 7 Drawing Sheets

ARCHERY BOW SLING AND RELATED METHOD OF USE

BACKGROUND OF THE INVENTION

The present invention relates to archery bow slings, and more particularly to an archery bow sling including an integrated quiver that is removable with the sling from the archery bow.

Many archers and bow hunters transport arrows for shooting from an archery bow in an arrow quiver that is rigidly fixed to the archery bow. A quiver typically includes a mount secured to a riser of the archery bow with fasteners. Some quivers are designed with a quick release built into the hardware of the mount, so that the quiver can be rotated or mechanically released from the mount if desired by the archer to lighten or to balance the archery bow when being readied for shooting or hunting. When the quiver is removed from the archery bow mount, the archer sometimes may find it difficult to find a ready and secure place to store the quiver to quickly access it, and more particularly, to remove the arrows from the quiver.

To further ease transport of the archery bow and a quiver holding arrows mounted to the bow, some archers also use bow slings. Bow slings typically include a large continuous sheath that is commonly and simultaneously placed over opposing cams of the bow and over the bowstring, similar to an envelope. An elongated strap is stitched to the large sheath and configured to be slung over a shoulder of a user to carry the bow with its quiver attached to it. Many conventional slings, however, do not fit perfectly around the quiver, and sometimes can interfere with operation and removal or release of the quiver from the mount on the archery bow. Further, where the sheath is overly large, it sometimes can cover the arrows, so that the arrows are difficult to access and remove from the quiver. In other cases, the sheath can overlap and bend the arrows toward the bow over long periods of time, which may compromise the integrity and flight of the arrows.

Accordingly, there remains room for improvement in the field of bow slings and arrow quivers to facilitate transport and protection of arrows and archery bows simultaneously, as well as to provide organization, protection and access of arrows from an arrow quiver.

SUMMARY OF THE INVENTION

An archery bow sling can include one or more cam covers that can cover respective cams of an archery bow, a base panel, an arrowhead hood extending away from a cam cover adjacent the base panel, an arrow retainer between the hood and another cam cover, the arrow retainer defining slots to receive one or more arrows, and a sling strap joined with the cam covers on opposing ends of the bow sling.

In one embodiment, the bow sling can be selectively removable from the archery bow with the arrows being carried and stored by a quiver portion of the sling and separate from the archery bow, which itself can be quiverless. The sling can include cam straps that removably wrap around a portion of the cams and/or limbs of the archery bow to securely but removably secure the bow sling to the bow.

In another embodiment, the bow sling can include a fletching guard distal from the hood and configured to extend over fletchings joined with the arrows. The fletching guard can be elastic and/or can include elastic members that enable the fletching guard to be stretched and/or expanded to cover the fletchings and to be removed therefrom.

In still another embodiment, the sling can include a string cover panel that provides or forms part of a string compartment that receives and/or protects a bowstring of the bow. The string cover panel can include an interior surface and an exterior surface. The base panel can include an interior surface and an exterior surface. The string cover panel interior surface can face the base panel interior surface, but can be spaced therefrom to provide a string compartment configured to receive the bowstring of the archery bow.

In yet another embodiment, the sling can include an elastic panel joined with a distal cam cover and extending to or joined with the base panel. The elastic panel can stretch between the base panel and the distal cam cover so that the sling can be stretched at least along the elastic panel to place the respective cam covers over the respective cams of the bow. The elastic panel can contract and can be in tension between the cam covers to retain the cam covers in forced engagement with the respective cams.

In even another embodiment, the base panel can include a base panel rear surface. The elastic panel can include an elastic panel rear surface. The sling can be reconfigurable in a tree storage mode, in which the elastic panel rear surface is placed adjacent the base panel rear surface, and the cam covers, which were previously distal from one another, are placed adjacent one another. Optionally, the base panel and/or the elastic panel can include a fold in the tree storage mode. Arrows carried by the sling can extend outward beyond the fold in the tree mode in a cantilevered manner, with fletchings likewise extending beyond the fold.

In a further embodiment, the arrowhead hood can include a roof and a sidewall. The upper roof and the sidewall can form a cavity defining an opening facing toward the distal cam cover. The cavity can enclose or house multiple arrowheads when disposed in the hood, to protect the heads from the environment and/or the user from the heads. Optionally, the hood can be constructed from a rigid material, such as a polymer, composite, metal or other material.

In still a further embodiment, the sling can include one or more pull loops joined with the cam covers. The pull loops can be disposed adjacent an outer edge or rim of a cam cover so that a user can pull the cam cover over a respective cam upon installation of the bow sling relative to the archery bow. The pull loops optionally can be used as a connection point for a hoisting rope to pull the archery bow up to an elevated stand with the bow sling attached to the bow.

In yet a further embodiment, a method of using an archery bow sling is provided. The method can include providing an archery bow with cams and a bowstring moveable in a bowstring plane; installing a first cam cover to cover a first cam; installing a second cam cover to cover a second cam; extending a base panel between the first cam and the second cam, optionally offset from but parallel to the bowstring plane; extending a string cover panel over the bowstring between the first cam cover and the second cam cover; providing an arrowhead hood extending away from the first cam cover toward the second cam cover, the arrowhead hood being separated from the archery bow and unattached thereto; supporting the arrows within multiple arrow slots distal from the hood and defined by an arrow retainer located between the hood and the second cam cover; and extending a sling strap between the first cam cover and the second cam cover. A user can place the sling strap over a shoulder of the user to support and carry an archery bow with the bow sling.

In even a further embodiment, the method can include stretching an elastic panel between the first cam cover and the second cam cover to install the first cam cover and the second cam cover relative to the first cam and the second cam. The elastic cover can be stretchable between the base panel, which can be less elastic and/or more rigid than the elastic panel, and the second cam cover.

In another embodiment, the method can include covering multiple fletchings of the arrows with a fletching guard while the first and second cam covers are installed relative to the first and second cams. The fletching guard can include at least one elastic band, and a user can pull on the band to stretch it and deform it to be pulled over the fletchings.

The current embodiments provide an archery bow sling with an integrated quiver and related method of use. Where the quiver is integrated into the bow sling, an extra mechanical mount can be deleted from an archery bow to mount the quiver directly and mechanically to the bow. The sling itself can be elastic or rigid in different portions to enable the sling to fit over cams on the bow, yet still protect and provide a solid support base for the arrows relative to the archery bow. The arrow retainer can include the arrow retaining walls, which can properly and consistently support the arrows relative to the hood and to a base panel between opposing cam covers. Where included, the fletching guard can conceal and protect fletchings of arrows stored relative to the quiver.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
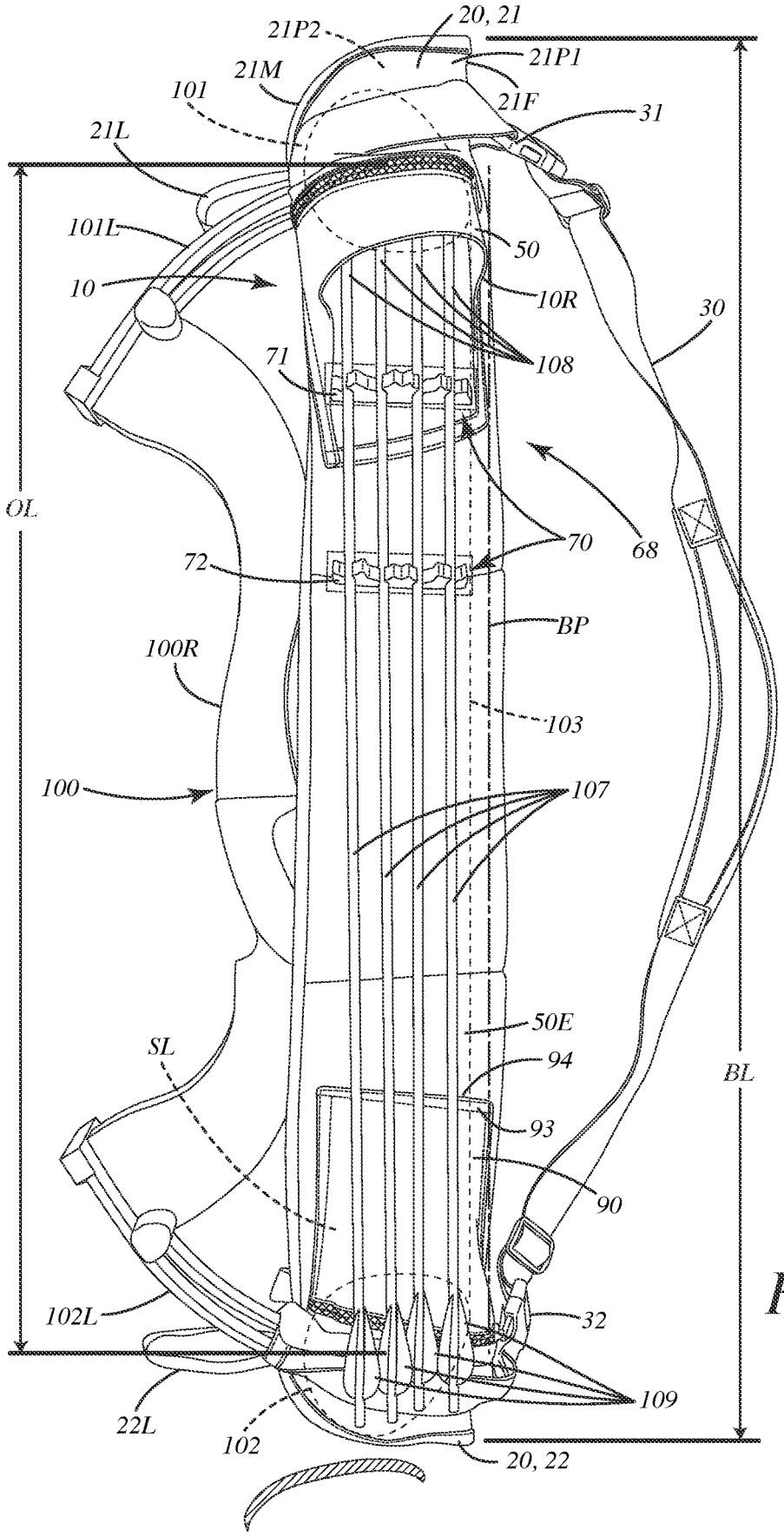
FIG. 1 is a first side perspective view of an archery bow sling of a current embodiment installed relative to an archery bow with arrows installed in the quiver portion of the sling.

A current embodiment of the archery bow sling with an integrated quiver is shown in FIGS. 1-4 and generally designated 10. The bow sling 10 in FIG. 1 is shown installed on an archery bow 100 having a riser 100R, to which opposing first 101 and second 102 cams are rotatably joined, and between which a bowstring 103 is strung and moveable in a bowstring plane BP when the bow is drawn and shot. The cams can be secured to the riser 100R via respective limbs 101L and 102L. Although shown mounted on a compound bow, the sling is well suited for recurve bows, long bows, crossbows and other projectile shooting devices.

Figure 4:
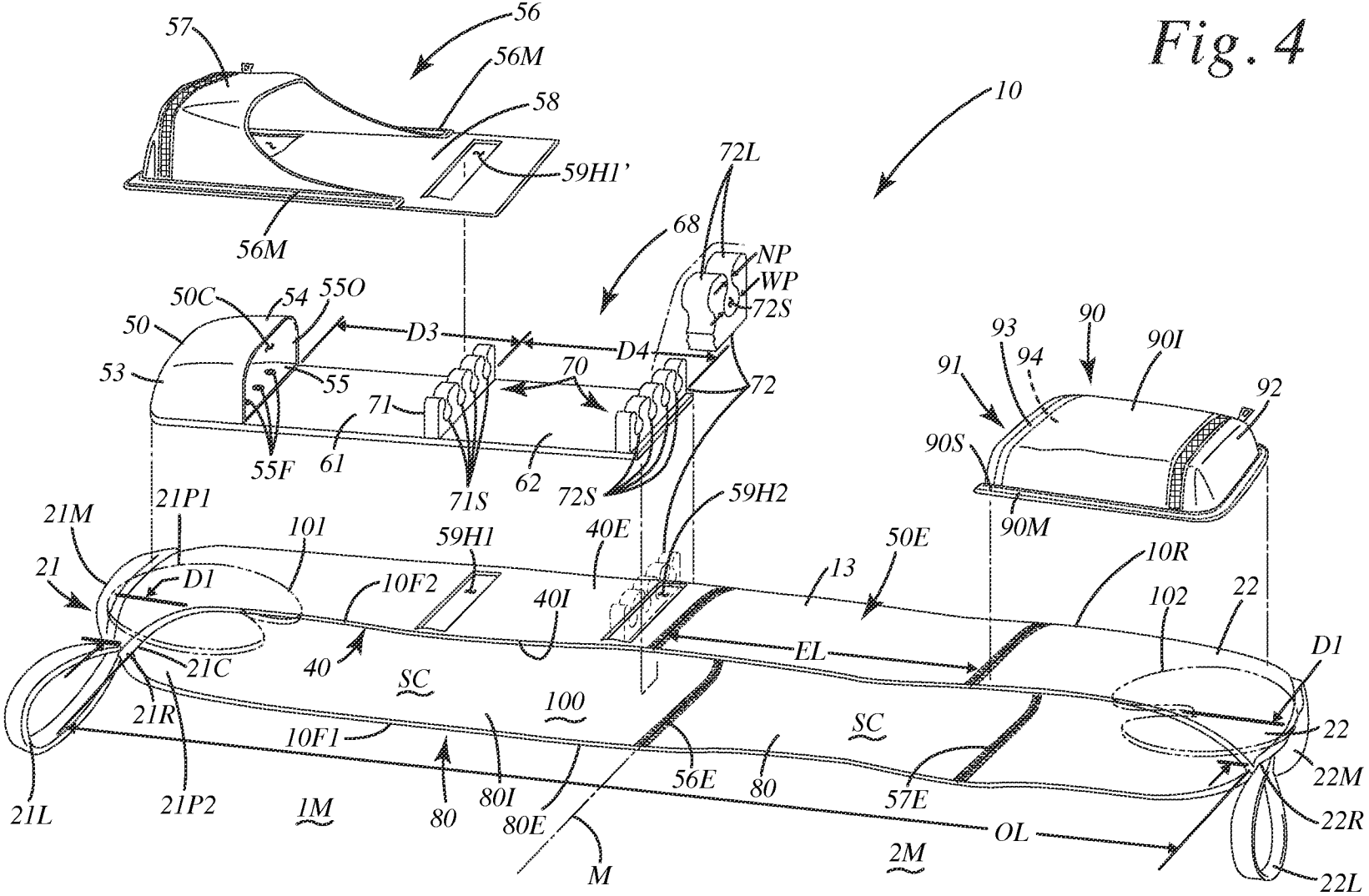
FIG. 4 is an exploded view of the archery bow sling.

The bow sling 10 shown in FIGS. 1 and 4 can include a first cam cover 21 and a second cam cover 22, collectively referred to as cam covers 20. The cam covers can be sized and shaped to conceal, cover and/or protect the respective first cam 101 and second cam 102 of the archery bow 100. As used herein, a cam can refer to a pulley, an eccentric cam, a wheel or other rotating component of an archery bow. Likewise, a cam cover can cover, conceal and/or protect any type of cam. The cam covers can be substantially similar to one another, so only the first cam cover 21 will be described in detail here. In general, the cam cover 21 can include at first cam cover panel 21P1 and an opposing second cam cover panel 21P2 that are sewn together along a margin 21M that extends upwardly and above the respective first cam 21. This margin 21M can be sewn with a conventional zigzag stitching or other type of stitch technique. The margin 21M can extend toward a rearward edge 10R of the bow sling 10 that covers the rearward portion of the bow including the bowstring 103 and the cams 101 and 102. Thus at this rearward edge 10R, the cam cover 21 can include a cam cover fold 21F at which the first panel 21P1 and second panel 21P2 are connected and optionally folded over relative to one another to form a compartment, recess or cavity 21C within the cam cover 21.

As shown in FIG. 4, the first cam cover 21 can extend forward along with the first panel 21P1 and the second panel 21P2 to a forward edge or rim 21R. This edge or rim 21R can extend forwardly beyond the front edges 10F1 and 10F2 of the bow sling 10 a distance D1. This rim 21R can be a curved or arc shape and can overlap a forward portion of the cam 101 when the cam is disposed in the cam cover 21 or its compartment 21C. This rim 21R can extend forwardly and downwardly along a forward portion of the cam cover 21. The rim can effectively lock and secure the sling 10 and in particular the first cam cover 21 over the first cam 101. The second cam cover 22 as described above can be similar or identical, but reversed from the first cam cover 21 described above. The second cam cover 22 also can include an edge or rim 21R that extends outwardly the distance D1 from the front edges 10F1 and 10F2 of the sling 10. The rims of the cam covers can form an opening 10O adjacent the forward edges 10F1 and 10F2 of the sling 10. This opening 10O can have an overall opening length OL between the closest points of the respective rims of the cam covers 21 and 22. This overall opening length OL can be less than the overall length BL of the bow, which can include portions of that length provided by the cams and bowstring, as shown in FIG. 1. With this discrepancy in the opening length OL relative to the bow length BL, when the sling is installed, the cams and bowstring can be secured and held within the sling 10, captured within the opening 10O. As described below, the bow sling 10 can include one or more elastic panels or portions that allow the bow sling to be stretched, and the overall opening length OL to be increased to that of the bow length BL, so that the sling and cam covers can be disposed over the respective cams 101 and 102 as well as the bowstring. The elasticity of the portions of the panels of the bow sling can allow the bow sling to retract or contract, after having been stretched, so that the overall opening length OL decreases to less than the bow length BL to effectively capture the cams and bow length BL within the bow sling 10. In turn, this can secure the bow sling 10 to the bow 100.

Optionally, one or more of the cam covers 21 and 22 can include loops 21L and 22L that extend forwardly from the front edges or portions 10F1 and 10F2 of the bow sling, and optionally forward of the respective rims 21R and 22R. These loops can be configured as pull loops and can allow a user to pull on portions of the cam covers to increase the overall size or dimensions of the cam covers, and/or to increase the overall opening length OL of the opening 100 to install the bow string 10 relative to the archery bow 100. The loops 21L and 22L can be in the form of a strip or loop of fabric, polymer, composite, metal or other material. The loops can be sized so that a user can insert one or more digits through the loop and pull on the loops to perform various functions. Each of the loops can be stitched, sewn, fastened or otherwise secured to the respective margins 21M or 22M of the respective cam covers and can be used to manipulate those cam covers to slide, move or otherwise be disposed over the respective cams. The pull loops 21L and 22L also can be durable and rugged enough to accommodate a pull rope or line for a user to attach thereto. A user can thus attach that pull rope and pull the archery bow 100 installed relative to the bow sling 10 to an elevated stand, with the weight of the archery bow 100 being fully supported by the bow sling via the pull loop. Of course, in some applications, the pull loops can be absent from the construction.

As mentioned above and shown in FIGS. 1-4, the cam covers 21 and 22 can be disposed at opposite and distal ends of the bow sling 10. Each of the respective covers 21 and 22 optionally can include one or more additional cam straps 21S and 22S. These cam straps can include respective buckles, connectors or fasteners 21B, 22B that secure sections of the straps to one another to complete a loop that can extend around a forward portion of each of the respective cams 101 and 102, optionally below or within each of the respective limbs. With the straps 21S and 22S in these locations, forward of the cams, and under or inside each of the respective limbs 101L and 102L of the bow 100, the cam covers can be further secured to the archery bow 100. As an example, the bow sling 10 first can be secured to the archery bow via the respective rims 21R and 22R of the cam covers 21 and 22 overlapping the forward portions of the cams outside or above and below the respective limbs. Second, the straps 21S and 22S can further secure the bow sling 10 to the bow 100, inside, or below and above the respective upper and lower limbs. Each of the respective straps 21S and 22S can include a connector 21B, such as a buckle, hook and loop fastener, button, cam release, pressure button, D loop, or other type of securement mechanism so that these straps can be secured and released relative to their respective cams and the bow in general.

The sling 10 also can include a sling strap 30 which can be secured to the first and second cam covers or other portions of the bow sling 10. The sling strap 30 can extend from adjacent the first cam 101 to adjacent to second cam 102, and can be secured to the bow sling adjacent those respective cams to provide a balanced and evenly distributed weight of the bow within the bow sling 10 when being carried by a user. Optionally, the ends of the strap can be disposed at other sections or at other portions of the bow sling 10, depending on the application and the shape or configuration of the archery bow with which the bow sling is used. The strap can be adjustable and can include sections of padding. Further optionally, each of the ends 31 and 32 of the strap 30 can include respective buckles 31B and 32B that can enable the strap 30 to be disconnected from the main body 13 of the bow sling 10. These buckles can be substituted with any type of quick connector, such as hook and loop fasteners, buttons, fasteners or other elements. In other applications, the strap 30 can be permanently secured and stitched to the cam covers 21 and 22 and/or a main body 13 of the sling 10.

The bow sling 10 as shown in FIGS. 1-4 as mentioned above can include a base panel 40 that forms one or more portions of the main body 13. Optionally, the base panel 40 can be joined with and/or integral with the first cam cover 21. The base panel 10 can be constructed from a fabric, a polymer or other material, optionally flexible, rather than rigid in the embodiment as shown. The base panel 40 can be distal from the second cam cover 22 and optionally can be separated from that cam cover by an elastic panel 50E. The elastic panel 50E can be elastic and stretchable. In some cases, the elastic panel can include a length EL shown in FIG. 4 that can increase by at least 1%, at least 2%, at least 5%, at least 10%, at least 25% or more to allow the overall opening length OL of the opening 10O increase such that the cam covers can be placed over the respective cams as described above. The base panel 40 can be stitched or otherwise secured to the elastic panel 50E, as can be the second cover cam cover 22.

Optionally, in some applications, the base panel 40, elastic panel 50E and cam covers 21 and 22 can be a constructed from one or more continuous elastic or inelastic panels that extend from one cam of the bow to the other. As shown however, the elastic panel 50E can be separately constructed but stitched to the base panel 40 and the second cam cover 22.

The bow sling 10 can include an arrowhead hood 50 extending away from the first cam cover 21. The arrowhead hood can be configured to conceal and protect arrow tips 108 attached to the arrows 107. The arrowheads can be field points, broadheads, game heads, judo points and other attachments to the forward ends of arrows carried by the bow sling, which are all collectively referred to herein as arrowheads. The arrowhead hood 50 can include an upper roof 53, a side wall 54 and a rearward wall 55. The upper roof 53 can cover the uppermost extremities of each of the arrowheads and/or the arrows. The sidewall 54 can extend downwardly to cover any blades of the respective arrowheads. The back wall 55 can be disposed opposite the side wall 54 and can be secured with fasteners to a base plate 60 as described below with fasteners 55F, which can be in the form of rivets, screws, welds, fused portions or other constructions used to join one element to another.

The hood 50 shown in FIG. 4 can be constructed from a rigid polymeric material that generally does not easily compress or crush without becoming damaged or substantially deformed. The material can be thick enough to protect the arrowheads 108 within the cavity 50C that is defined by the sidewalls 54 and the roof 53. The cavity can include an opening 550 that can face downward, toward the second cam cover 22. The cavity optionally can include a foam insert (not shown) that can receive portions of the arrowheads therein and provide further securement of those arrowheads within the quiver portion 68, and/or to prevent rattling or movement of the arrowheads relative to the hood 50.

With further reference to FIG. 4, the hood 50 can be attached to a base plate 60. The base plate 60 as shown can include a first portion 61 and a second portion 62. The first portion 61 can extend from the hood 50 to the arrow retainer 70, generally connecting these components. In some applications, the portion 61 can be deleted from the construction so that the hood 50 and second portion 62, along with the arrow retainer 70, are stitched, sewn, fastened or otherwise secured to the base panel 40 of the bow sling 10. As shown however, the first portion 61 and second portion 62 can be a continuous plate. The plate itself can be sewn, stitched, fastened or otherwise secured to the base panel 40. In some cases, the plate 60 can be concealed by fabric that extends over the surfaces of the base plate to integrate the base plate into the remainder of the bow sling 50. The base plate 60 can be constructed from a rigid or semi-rigid polymeric material. In some cases, the plate 60 can be constructed from a composite, metal or other material.

As shown in FIG. 4, the plate 60 can be joined with, secured and/or integral with the arrow retainer walls 70. These arrow retainer walls 70 can include a first or upper retainer wall 71 and a second or lower retainer wall 72. The first wall 71 can be closer to the hood 50 than the second wall 72. The second wall 72 can be closer to the second cam cover 22 than the first wall 71. The arrow retainers can be located in the upper half 1M of the overall length of the bow sling 10. Optionally, the arrow retainers do not extend beyond the middle M of the length of the bow sling 10 into the second or lower half 2M of the bow sling. It has been discovered that by placing the arrow retainers here, the arrows can be adequately supported, yet more easily grasped and removed from the hood. Of course, in other applications, the arrow retainers can be placed in other locations along the bow sling, depending on the arrow length.

Each of the first wall 71 and second wall 72 of the arrow retainer 70 can include first 71S and second 72S arrow slots. These arrow slots can be elastically deformable and configured to receive and/or trap arrows therein. For example, the slots can be formed by lobed fingers 72L adjacent each one of the slots 72S, for example. The lobes 72S can form narrow portions NP of each of the respective slots and can open to wider portions WP having a greater dimension than the narrow portions NP of each of the slots. Thus, when an arrow is pressed past the narrow portions NP of the respective lobes 72 L, for example, the arrow can lock within the narrow portions NP of each of the slots to provide a secure fitment of that arrow relative to the respective wall and arrow retainer in general. This in turn can better secure and fasten the arrows relative to the arrow retainer 70.

The walls 71, as shown optionally, can be spaced a distance D3 from the arrow hood 50. The respective walls 71, further optionally can be spaced a distance D4 from one another. The distance D4 can be greater than the distance D3. In some cases, the distance D4 can be optionally between 2 inches and 24 inches, inclusive, between 2 inches and 12 inches, inclusive, between 2 inches and 6 inches, inclusive or other lengths depending on the length of the arrows 107. The first arrow slots 71S and second arrow slots 72S can be aligned linearly with one another and with the cavity 50C of the hood 50. This is so that the arrowheads 108 can fit within the hood 50, being concealed by the sidewall 54 and roof 53, while extending downwardly through the respective slots 71S and 72S of the respective arrow retainer walls 71 and 72. These arrow retainer walls also can be aligned to point toward the opening 94 of the fletching guard 90 and generally toward the second cam cover 22 such that the fletchings 109 attached the arrows 107 can fit therein.

Optionally, each of the first wall 71 and second wall 72 can extend perpendicularly upward relative to the plate 60 and particularly the second portion 62 of the plate 60. In some applications, these walls can be at a different angle relative to the plate 60. In further applications, additional third arrow retainer walls with respective slots, fourth retainer walls with respective slots, etc. can be added to the construction to provide further support to the arrows. With the current spacing and placement of the current retainer walls, however, it has been discovered that this provides adequate securement of the arrows 107 relative to the bow sling 100 yet still allows a user to easily remove each arrow from the quiver portion 68 thereof. This quiver portion 68 can include the one or more arrow retainers and/or the hood.

Further optionally, the hood 50 can be covered with a hood fascia or hood cover 56. This hood fascia 56 can include a portion 57 that covers the upper roof and side wall. This portion 57 can include a hood cover panel 58 that can extend beyond the hood 50, optionally along the base plate 60 as described below. In some applications, the hood cover 56 can be stitched along margins 56M to the base panel 40 and or the main body 13 of the bow sling. Further optionally, the hood cover panel 56 can include an arrow retainer hole 59H1' that can fit around an arrow retainer 70 as described below so that the arrow retainer 70, 71 extends upward and through the hole 59H. This can provide a clean fabric fit around the arrow retainer. Optionally, the base 40 also can define holes 59H1 and 59H2 through which the arrow retainers can fit. Although not shown, in some cases, the hood 50 and hood cover 57 can be an integral, one piece unit. In other cases, the hood 50 can be uncovered and can simply be an exposed hood secured to the base panel 40 via a stitch, a weld, fasteners or other connections.

As mentioned above, the arrowhead hood 50 can be joined with the base panel 40, as shown in FIGS. 1-4. The base panel 40 can be juxtaposed relative to a bowstring cover panel 80. This string cover panel 80 optionally can provide a cover over the bowstring 103 within the bowstring plane BP when the bow sling 10 is installed relative to the archery bow 100. The string cover panel 80 can include an interior surface 80I and an exterior surface 80E, as shown in FIG. 4. Likewise, the base panel 40 can include an interior surface 401 and an exterior surface 40E. The string cover panel interior surface 80I can face the base panel interior surface 401 and optionally can be spaced therefrom to provide a string compartment SC that is configured to receive and protect a bowstring 103 of the archery bow therein. In particular, when the bow sling 10 is installed relative to the bow 100, that is, the bow sling is secured at the cam covers over the cams, and the cams and bowstring are inserted into the opening 10O, passing the front edges 10F1 and 10F2 of the bow sling 10, the bowstring can enter into the string compartment SC. In this compartment SC, the respective string cover panel 80 and base panel 40, as well as the elastic panel 50 and portions of the first cam cover 21 and second cam cover 22 can cover, conceal and/or protect the bowstring and cams respectively.

Optionally, although indicated as different elements, the base panel 40 and the string cover panel 80 can form a single panel and/or can be part of a unitary piece. These components can be stitched, sewn, glued or otherwise connected along a rear edge or margin 10R of the bow sling 10.

Alternatively, where these panels are one panel, they can simply be folded along a fold or bend along that rear edge 10R, and can extend continuously from one side of the bow sling to the other.

Figure 2:
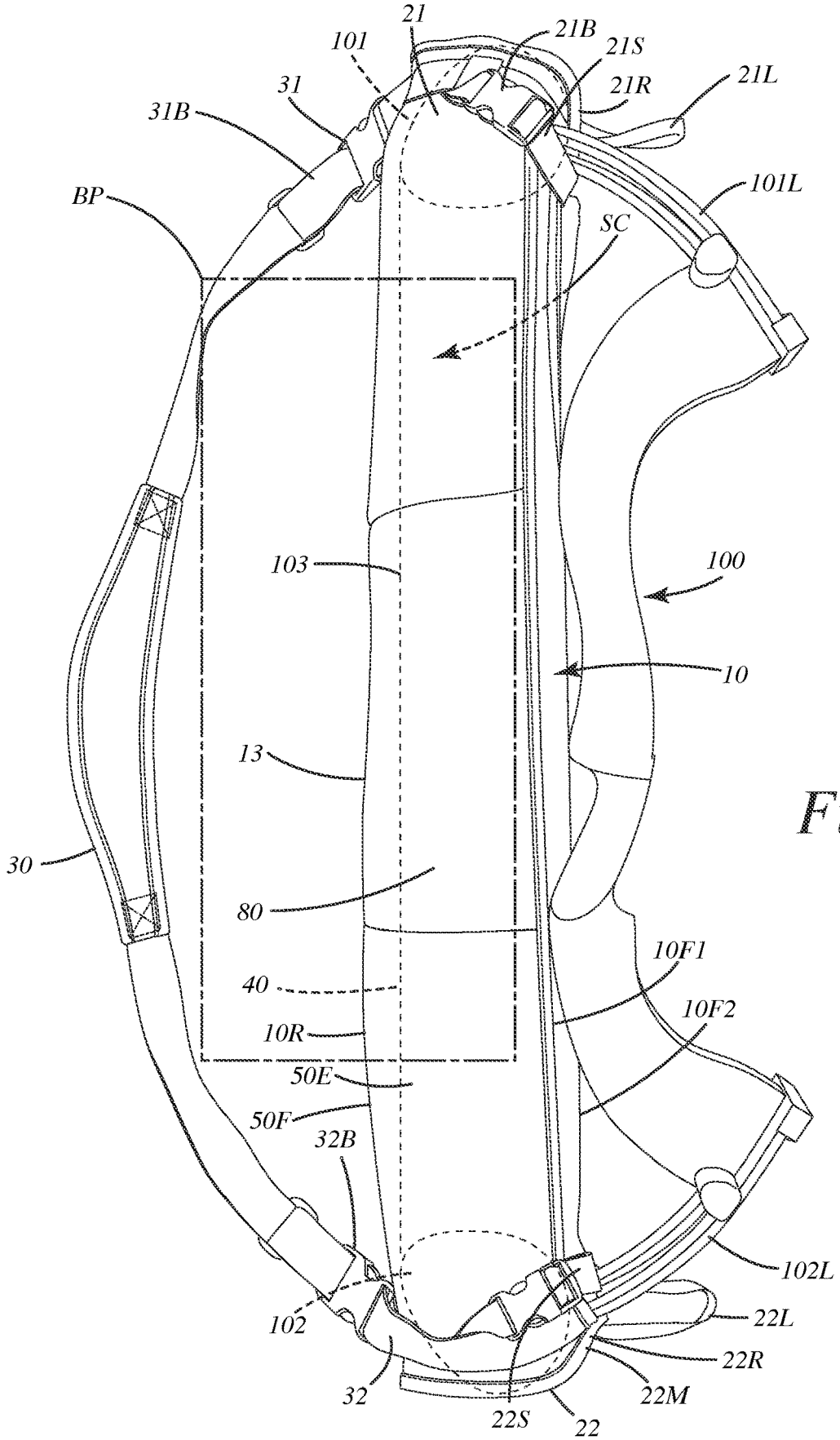
FIG. 2 is a second side perspective view of the archery bow sling installed relative to the archery bow.
Figure 3:
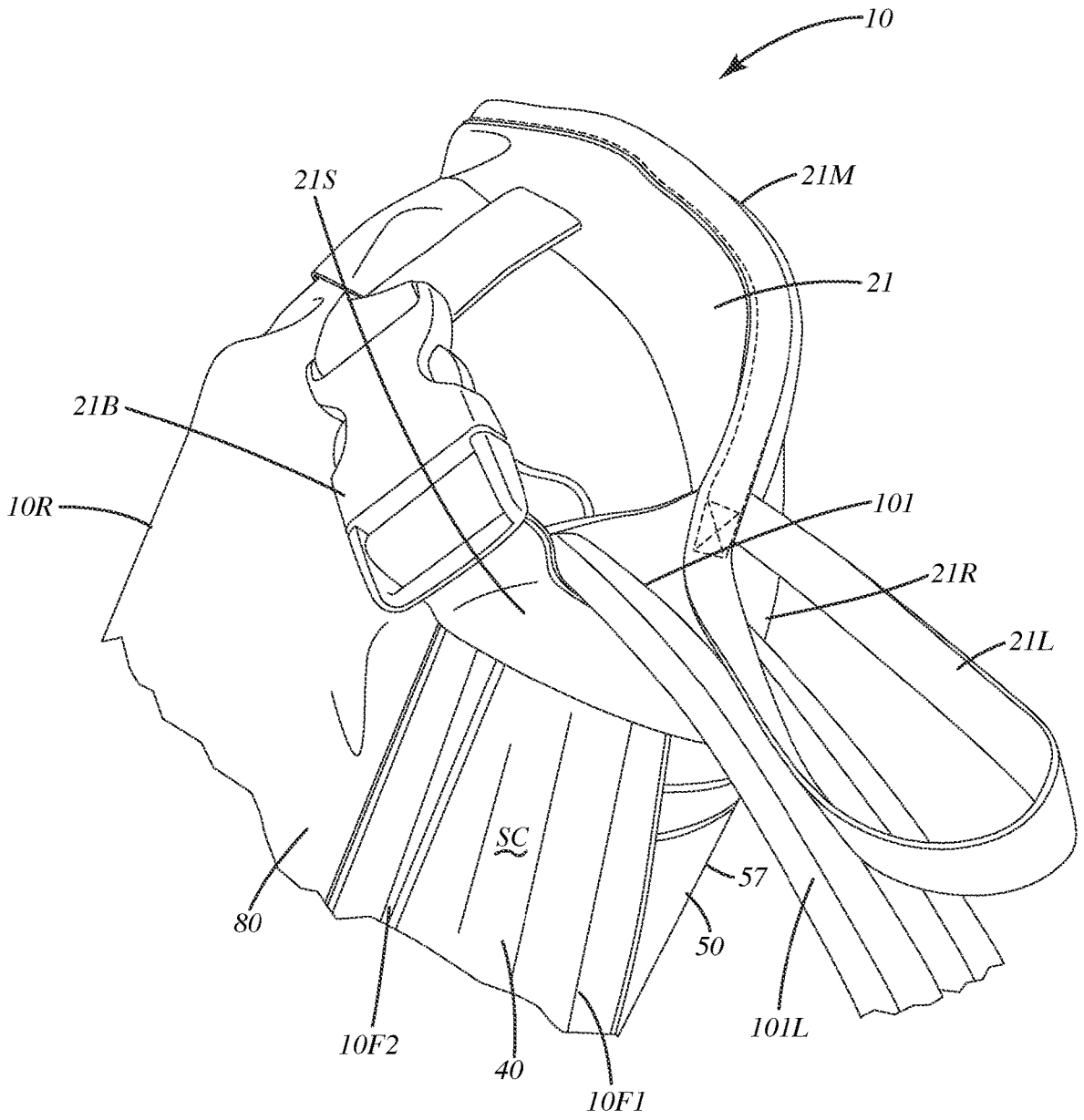
FIG. 3 is a perspective close-up view of a cam cover with a cam strap disposed around a cam of the archery bow, and a pull loop extending adjacent a rim of the cam cover for access of the same.

As shown in FIGS. 2 and 4, the string cover panel 80 optionally can extend and/or form a portion of the elastic panel 50E. In this case, the elastic panel 50E can be sewn, stitched fastened or otherwise secured at a seam 56E to the panels 40 and 80. At an opposing end of the elastic panel 50E, the second cam cover 22 can be sewn, stitched, fastened or otherwise secured to the elastic panel 50 at the seam 57E. As mentioned above, the elastic panel 50E, whether or not it is integral with a string cover panel 80, can cover, conceal and/or protect the bowstring 103 when the bow sling 10 is installed relative to the bow. The elastic panel 50E also can include a fold or bend 50F along the rear edge 10R of the bow sling 10. This fold or bend can transition from a first side of the bow sling to a second side of the bow sling, which correspond to opposing sides of the bowstring plane BP of the archery bow and/or its string.

As mentioned above, the elastic panel 50E can include elastic panel length EL. Due to the elastic nature of the elastic panel 50, the elastic panel length can increase or decrease by at least 1%, at least 2%, at least 5%, at least 10%, at least 20% or more to allow the overall length OL of the opening 10O to increase and allow the bow sling to be installed relative to the bow. The elastic panel optionally can be constructed from a one way stretch material, a two way stretch material, a four way stretch material or other types of stretchable material. The elastic panel 50 can in some cases be constructed from spandex, neoprene, elastic fabric or other stretchable and/or elastic materials. Further optionally, in some applications, the elastic panel 50 can be continuous with, or integral with, the respective string cover panel 80 and base panel 40 as well as the respective first and second cam covers. In this case, all of these panels and covers can be constructed from an elastic material that allows the bow sling to stretch in its length so that the opening length OL can be selectively modified or increased to fit and install the bow sling 10 relative to the bow 100.

As mentioned above, the bow sling 10 can include an optional fletching guard 90. The fletching guard 90 can optionally be sewn, stitched, fastened or otherwise connected to the elastic panel 50E, the string cover panel 80, and/or the second cam cover 22. As shown in FIGS. 1-4, the fletching guard 90 can be distal from the hood 50 and can be configured to extend over multiple fletchings 109 of arrows 107 disposed in the quiver portion 68 of the bow sling 10. The fletching guard 90 can be constructed from an elastic stretchable material or mesh. The fletching guard 90 can include a margin 90M that can be stitched with stitching 90S to a portion of the elastic panel 50E and or the cam cover 22. The flashing guard 90 can include an elastic band 93 disposed at its first end 91. That first end 91 can form an opening 94 into which portions of the arrows including the fletchings can be inserted. The elastic band 93 can be stretchable and can be constructed from a different material from the remainder of the fletching guard 90. The elastic band 93 can be stretched or pulled elastically away from the elastic panel 50E and/or the second cam cover 22 so that the fletchings 109 and portions of the arrow 107 can be inserted into the fletching guard 90 to protect the fletchings. Optionally, in use, the fletchings can be disposed outside the fletching guard 90 and can lay adjacent an exterior surface 90I of the fletching guard. During transport through an environment where the fletchings 109 might be exposed to brush, branches or other natural objects, the fletchings can be concealed and protected within the fletching guard 90 by user pulling on the elastic band 93 and placing the fletchings within the opening or cavity 94 of the guard 90. Optionally, although the second end 92 of the fletching guard 90 is shown as being sewn at the margin 90M to the cam cover 22, this second end 92 can be open or free from attachment to the cam cover 22, so that the fletching guard is simply a band that extends across the bow sling, generally from a forward edge 10F1 to a rear edge 10R of the bow sling 10.

The bow sling 10 of the current embodiment can be installed and removed from the bow 100 to provide carrying and protective functionality, with an arrow quiver attached directly to the bow sling, rather than the bow. One method for installing and/or using the archery bow sling 10 can include: providing an archery bow 10 including a first cam 101 and a second cam 102 distal from the first cam with a bowstring 103 disposed between the first cam and the second cam, the bowstring moveable in a bowstring plane BP; installing a first cam cover 21 to cover the first cam; installing a second cam cover 22 to cover the second cam; extending a base panel 40 between the first cam and the second cam, offset from the bowstring plane BP; extending a string cover panel 80 over the bowstring 103 between the first cam cover 21 and the second cam cover 22; and providing an arrowhead hood 50 extending away from the first cam cover 21 adjacent the base panel 40, the arrowhead hood 50 forming a cavity 50C defining an opening facing toward the second cam cover 22, the cavity housing a plurality of arrowheads 108 joined with a plurality of arrows 107 extending toward the second cam cover, the arrowhead hood 50 being separated from the archery bow 100 and unattached thereto.

The method also can include supporting the plurality of arrows 107 within a plurality of arrow slots 71S, 72S distal from the hood and defined by an arrow retainer 70 located between the hood 50 and the second cam cover 22; and extending a sling strap between the first cam cover and the second cam cover. After the bow sling is installed relative to the archery below 100, a user can place the sling strap 30 over a user shoulder to support and carry an archery bow with the bow sling.

The method of using the bow sling also can include pulling on the pull loops 21L, 22L to increase the opening length OL and place the cam covers over the respective cams 101, 102 as described above. Further, the elastic panel or other elastic portions of the bow sling can be stretched or put under tension between the first cam cover and the second cam cover to install the first cam cover and the second cam cover relative to the first cam and the second cam. The method can include placing of the straps 21S, 22S around the respective cams and inside the respective bow limbs as described above. The strap 30 also can be attached and adjusted relative to the bow and bow sling as described above. Where desired, to provide further protection to the fletchings 109 of the arrows 107, the method can include covering the fletchings of the arrows with the fletching guard 90 while the first and second cam covers are installed relative to the first and second cams.

Figure 5:
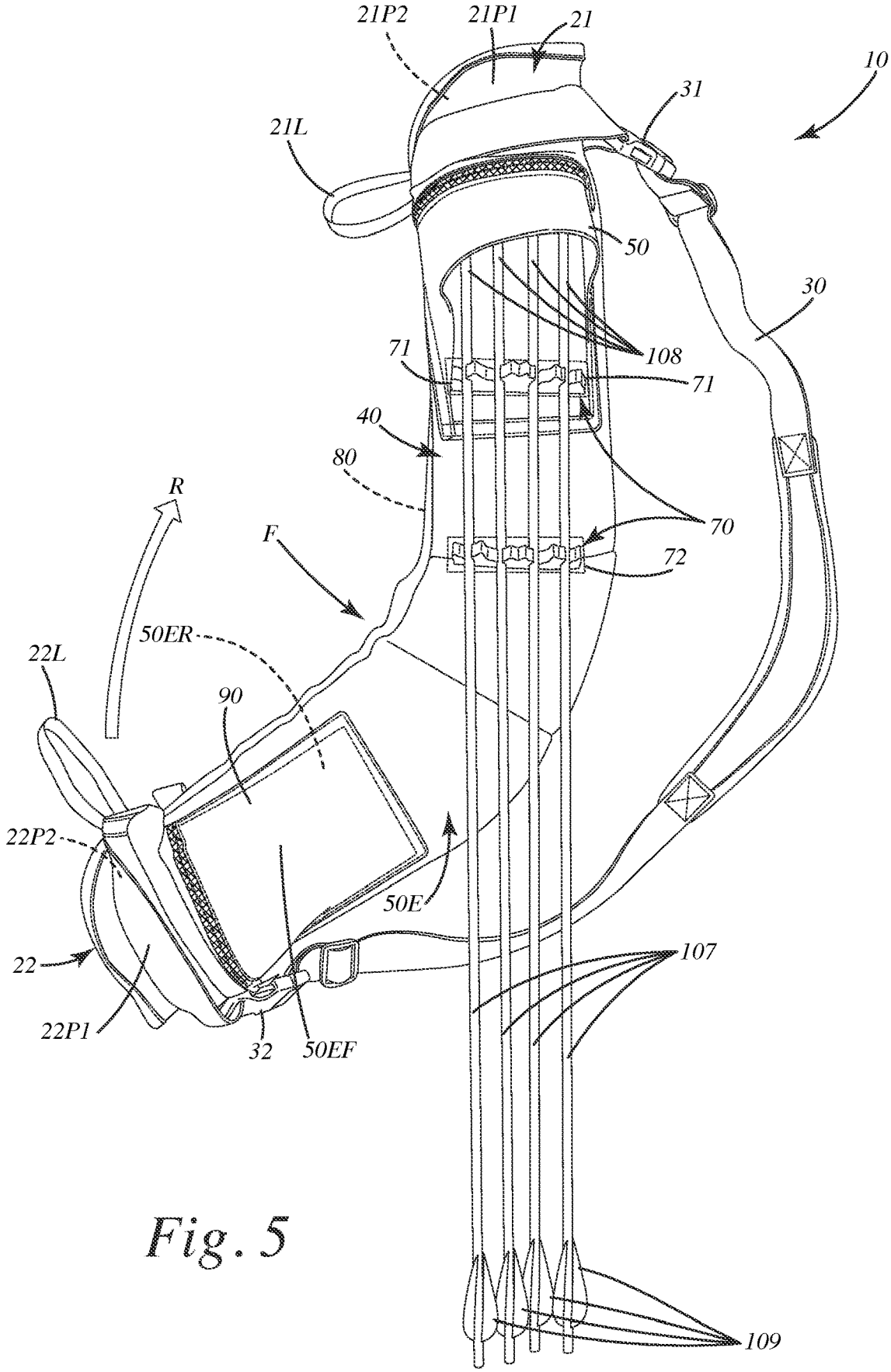
FIG. 5 is a side perspective view of the archery bow sling removed from the archery bow and being converted to a tree storage mode.
Figure 6:
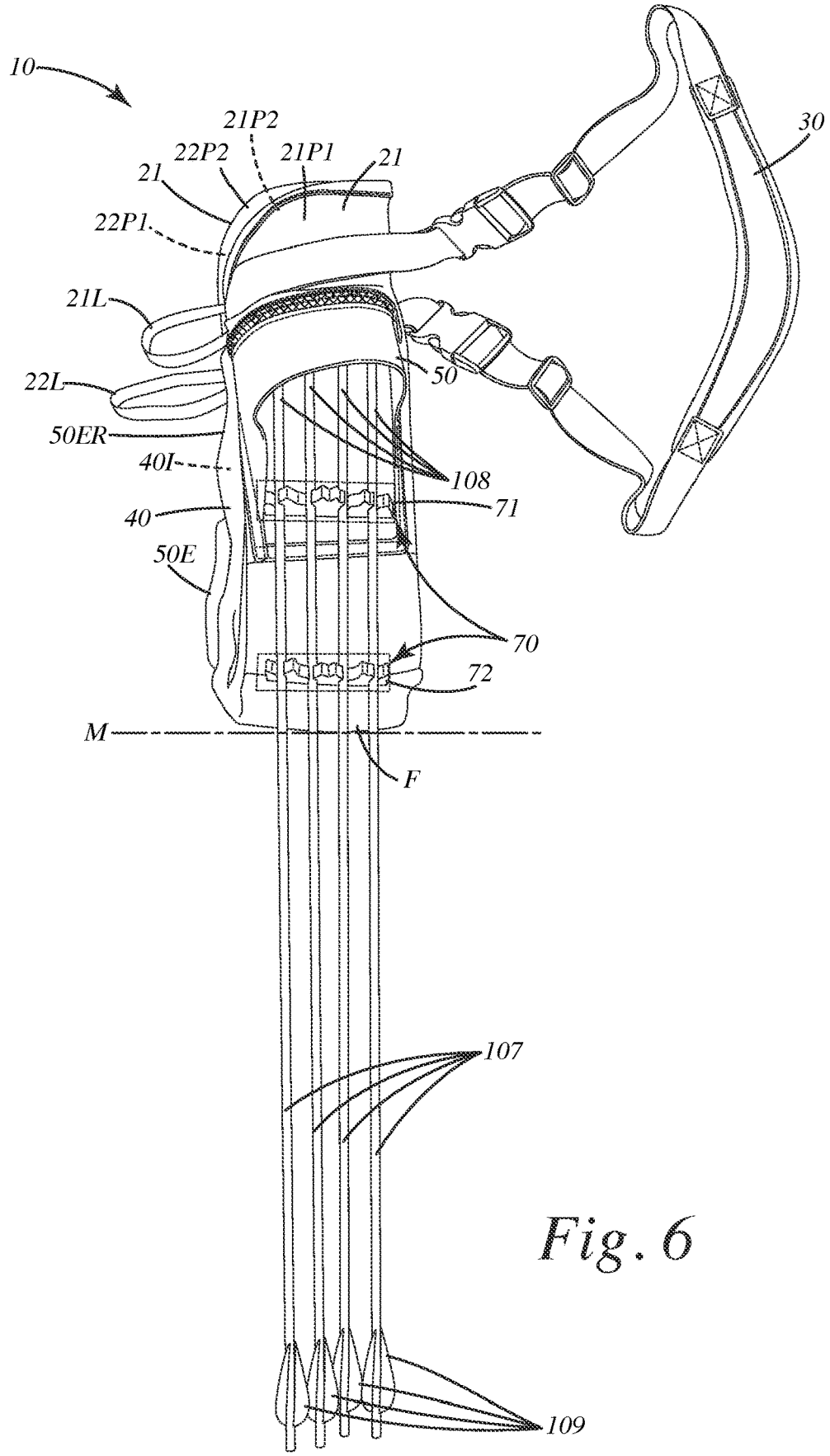
FIG. 6 is a side perspective view of the archery bow sling with a string cover panel and/or an elastic panel folded over a base panel to extend arrows past a folded portion of the archery bow sling.

As mentioned above, the bow sling 10 can be operable in a tree storage mode or tree mode, in addition to the sling mode shown in FIGS. 1-2. This tree mode can be better understood with reference to FIGS. 5-7. To attain this mode, the bow sling 10 can be removed from the archery bow 100, for example, by pulling on the pull loops 21L, 22L and removing the rims 21R and 22R from the respective portions of the cams. The cam straps 21S and 22S also can be loosened and/or removed from the respective limbs and/or cams so that the cam covers can be removed from the respective cams 101 and 102, and the panels can be removed from the bowstring 103. After removal from the bow, the bow sling 10 can be in the configuration shown in FIG. 5. There, the fletchings 109 are removed from the fletching guard 90. The arrows 107 are still retained by the arrow retainer 70 and within the slots of the respective walls 71 and 72. The arrows 107 project beyond the arrow retainer 70 in a cantilevered manner as shown in FIG. 5.

In transitioning to the tree mode, the elastic panel 50E and the second cam cover 22 can be moved upward in direction R, starting to form a bend or fold F within the respective panels of the bow sling 10. The rear surface 50ER (opposite the front surface 50EF) of the elastic panel 50E and the rear panel 22P2 of the second cam cover 22 can be moved in direction R. This movement can continue until the bow sling 10 achieves the configuration shown in FIG. 6. There, the elastic panel rear surface 50ER is placed adjacent the interior or rear surface 40I of the base panel 40. The second cam cover 21 also can be placed adjacent the first cam cover 21 on the same side of the fold F, which in some cases can correspond to the prior middle M of the bow sling 10. Optionally, the panel 21P2 of the first cam cover 21 can be placed adjacent the panel 22P2 of the second cam cover 22 in this tree mode. Further optionally, the straps 21S and 22S can be used to secure the cam covers 21 and 22 adjacent one another.

Figure 7:
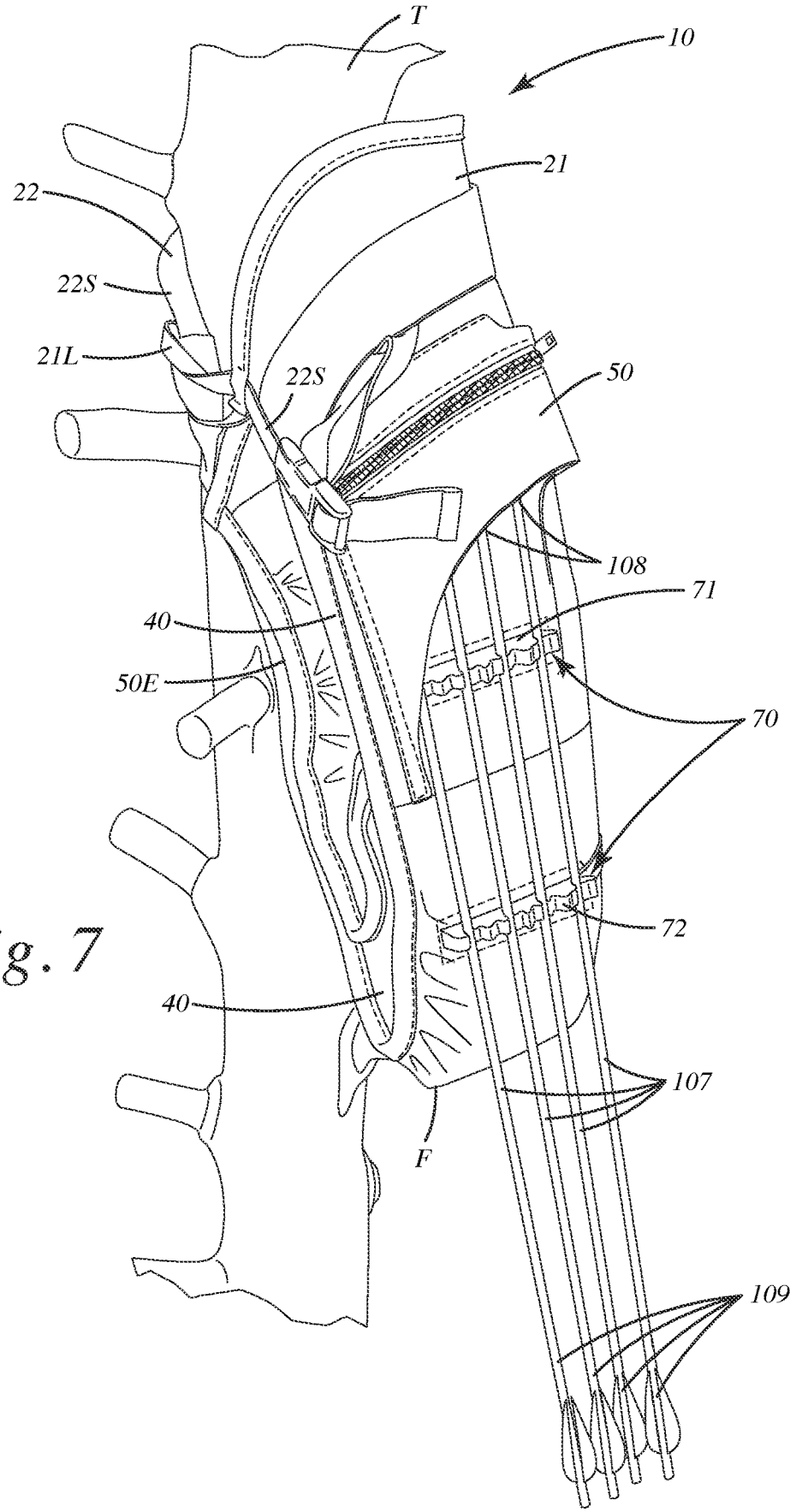
FIG. 7 is a perspective view of the archery bow sling in the tree storage mode and installed relative to a tree to provide access to arrows stored in the quiver portion of the archery bow sling.

With the bowstring in this tree storage mode, a user can secure the bow sling 10 to a tree T as shown in FIG. 7. There, the bow sling 10 can be secured with the loops 21L and/or straps 21S to the tree T. The arrows 107 can be retained in the arrow retainer 70 over the base panel 40, with the arrowheads 108 still retained in the arrowhead hood 50. The bow sling 10 and arrows 107 can generally extend vertically downward. The ends of the arrows with the fletchings 109 can extend past the fold F of the bow sling 10 in a cantilevered manner and can be easily accessed by a user. When the user is ready to depart the location, the user can remove the bow sling 10 from the tree T and reinstall the bow sling 10 relative to the archery bow 100. The user can use the bow sling 10 to transport the archery bow to a subsequent location.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An archery bow sling comprising:

a first cam cover configured to cover a first cam of an archery bow;

a base panel to which the first cam cover is joined;

a second cam cover distal from the first cam cover, the second cam cover configured to cover a second cam of the archery bow distal from the first cam, the first cam and second cam having a bowstring extending therebetween, the bowstring moveable in a bowstring plane, but not when the first and second cam covers are installed relative to the respective first cam and second cam;

an elastic panel joined with the second cam cover and extending to the base panel;

an arrowhead hood extending away from the first cam cover adjacent the base panel, the arrowhead hood including an upper roof and a sidewall, the upper roof and the sidewall forming a cavity defining an opening facing toward the second cam cover, the cavity configured to house a plurality of arrowheads when disposed in the arrowhead hood, the arrowhead hood being constructed from a rigid polymeric material;

a fletching guard extending away from the second cam cover toward the first cam cover, the fletching guard configured to extend over a plurality of fletchings disposed on a plurality of arrows that are joined with the plurality of arrowheads;

an arrow retainer between the arrowhead hood and the fletching guard, closer to the arrowhead hood than the second cam cover, the arrow retainer including a first wall defining a plurality of first arrow slots and a second wall defining a plurality of second arrow slots, the second wall being a distance of between 2" and 24", inclusive, from the first wall, the first arrow slots and the second arrow slots being aligned with one another and with the cavity of the arrowhead hood; and a sling strap joined with the first cam cover and with the second cam cover, wherein the archery bow sling places the arrows distal from the archery bow but within a plane parallel to the bowstring plane of the archery bow supported by the sling, wherein the archery bow sling is selectively removable from the archery bow with the plurality of arrows being carried by the archery bow sling.

2. The archery bow sling of claim 1, wherein the base panel includes a rigid polymeric panel inside a base panel fabric cover.

3. The archery bow sling of claim 2, wherein the elastic panel is joined with the base panel fabric cover.

4. The archery bow sling of claim 3, wherein the base panel includes a base panel rear surface, wherein the elastic panel includes an elastic panel rear surface, wherein the sling is reconfigurable in a tree storage mode, in which the elastic panel rear surface is placed adjacent the base panel rear surface, and the second cam cover is placed adjacent the first cam cover, wherein at least one of the base panel and the elastic panel include a fold in the tree storage mode, wherein the plurality of fletchings extend outward beyond the fold in the tree storage mode.

5. The archery bow sling of claim 1, wherein the fletching guard includes an elastic band configured to extend over the plurality of arrows and a fletching cover between the elastic band and the second cam cover, the fletching cover configured to extend over the plurality of fletchings.

6. The archery bow sling of claim 1 comprising:

a first sling connector removably connecting a first end of the sling strap to the first cam cover; and a second sling connector removably connecting a second end of the sling strap, distal from the first, to the second cam cover.

7. The archery bow sling of claim 1, comprising:

a fabric hood cover extending over the arrowhead hood, wherein the fabric hood cover is joined with the base panel via stitching.

8. The archery bow sling of claim 1, wherein the arrow retainer includes a base wall rigidly joined with the first wall and the second wall to support the first arrow slots in alignment with the second arrow slots.

9. The archery bow sling of claim 8, wherein the base wall is joined with the base panel distal from the arrowhead hood, wherein the base wall is in the form of a plate and includes a first end and a second end distal from the first end, wherein the first wall is joined with the first end and perpendicular to the plate, wherein the second wall is joined with the second end and perpendicular to the plate.

10. The archery bow sling of claim 1, wherein the first cam cover is joined with a first cam strap configured to wrap around the first cam to secure the first cam cover to the archery bow, wherein the second cam cover is joined with a second cam strap configured to wrap around the second cam to secure the second cam cover to the archery bow.

11. The archery bow sling of claim 1 comprising:

a string cover panel, wherein the fletching guard extends away from the string cover panel.

12. An archery bow sling comprising:

a first cam cover configured to cover a first cam of an archery bow;

a base panel to which the first cam cover is joined;

a second cam cover distal from the first cam cover, the second cam cover configured to cover a second cam of the archery bow distal from the first cam;

an arrowhead hood extending away from the first cam cover adjacent the base panel, the arrowhead hood including an upper roof and a sidewall, the upper roof and the sidewall forming a cavity defining an opening facing toward the second cam cover, the cavity configured to house a plurality of arrowheads when disposed in the arrowhead hood, the arrowhead hood being constructed from a rigid material;

an arrow retainer between the arrowhead hood and the second cam cover, closer to the arrowhead hood than the second cam cover, the arrow retainer defining a plurality of slots configured to elastically deform and receive the plurality of arrows;

a sling strap joined with the first cam cover and with the second cam cover;

a fletching guard distal from the arrowhead hood and configured to extend over a plurality of fletchings disposed on a plurality of arrows that are joined with the plurality of arrowheads; and a string cover panel including an interior surface and an exterior surface, wherein the base panel includes an interior surface and an exterior surface, wherein the string cover panel interior surface faces the base panel interior surface but is spaced therefrom to provide a string compartment configured to receive a bowstring of the archery bow, wherein the sling is selectively removable from the archery bow with the plurality of arrows being carried by the archery bow sling.

13. The archery bow sling of claim 12, wherein the arrow retainer includes a base wall, and a first upright wall and a second upright wall extending from the base wall and distal from one another, wherein each of the first upright wall and the second upright wall define the plurality of slots.

14. The archery bow sling of claim 13, wherein the base wall is stitched to the base panel, wherein the arrowhead hood is covered with a hood cover constructed from fabric that is stitched to the base panel.

15. The archery bow sling of claim 14, wherein the base panel lays within a plane offset from a bowstring plane of the archery bow when the bow sling is installed relative to the archery bow.

16. The archery bow sling of claim 12, wherein the arrowhead hood and the arrow retainer are joined with the exterior surface of the base panel so as to hold the plurality of arrows outward from the bowstring.

17. An archery bow sling comprising:

a first cam cover configured to cover a first cam of an archery bow;

a base panel to which the first cam cover is joined;

a second cam cover distal from the first cam cover, the second cam cover configured to cover a second cam of the archery bow distal from the first cam, the first cam and second cam having a bowstring extending therebetween, the bowstring moveable in a bowstring plane, but not when the first and second cam covers are installed relative to the respective first cam and second cam;

an arrowhead hood extending away from the first cam cover adjacent the base panel, the arrowhead hood including an upper roof and a sidewall, the upper roof and the sidewall forming a cavity defining an opening facing toward the second cam cover, the cavity configured to house a plurality of arrowheads when disposed in the arrowhead hood;

a fletching guard extending away from the second cam cover toward the first cam cover, the fletching guard configured to extend over a plurality of fletchings disposed on a plurality of arrows that are joined with the plurality of arrowheads;

an arrow retainer between the arrowhead hood and the fletching guard, closer to the arrowhead hood than the second cam cover, the arrow retainer including a first wall defining a plurality of first arrow slots and a second wall defining a plurality of second arrow slots, the first arrow slots and the second arrow slots being aligned with one another and with the cavity of the arrowhead hood; and a sling strap joined with the first cam cover and with the second cam cover, wherein the archery bow sling places the arrows distal from the archery bow but within a plane parallel to the bowstring plane of the archery bow supported by the sling, wherein the archery bow sling is selectively removable from the archery bow with the plurality of arrows being carried by the archery bow sling.

18. The archery bow sling of claim 17 comprising a string cover panel including an interior surface and an exterior surface, wherein the base panel includes an interior surface and an exterior surface, wherein the string cover panel interior surface faces the base panel interior surface but is spaced therefrom to provide a string compartment configured to receive a bowstring of the archery bow.

19. The archery bow sling of claim 17 comprising a string cover panel, wherein the fletching guard extends away from the string cover panel.

* * * * *